United States Patent [19]

Orrell et al.

[11] Patent Number: 4,886,027

[45] Date of Patent: Dec. 12, 1989

[54] FUEL INJECTION TEMPERATURE COMPENSATION SYSTEM

[75] Inventors: William B. Orrell, Sterling Heights; Wendell D. Creps, Lake Orion, both of Mich.

[73] Assignee: General Motors Corporation, Detroit, Mich.

[21] Appl. No.: 226,328

[22] Filed: Jul. 29, 1988

[51] Int. Cl.[4] ..... F02D 41/04

[52] U.S. Cl. ..... 123/478; 123/494

[58] Field of Search ..... 123/421, 478, 480, 494, 123/491; 73/116, 117.3

[56] References Cited

U.S. PATENT DOCUMENTS

| | | | |
|---|---|---|---|
| 4,424,783 | 1/1984 | Kotwicki | 123/421 X |
| 4,495,925 | 1/1985 | Hasegawa | 123/480 |
| 4,499,879 | 2/1985 | Stoltman et al. | 123/480 |
| 4,594,986 | 6/1986 | Shimoda et al. | 123/478 X |
| 4,753,206 | 6/1988 | Inove et al. | 123/480 |

*Primary Examiner*—Tony M. Argenbright

*Attorney, Agent, or Firm*—Howard N. Conkey

[57] ABSTRACT

A method for calculating actual air charge temperature uses values of coolant temperature, ambient temperature and engine air flow. These parameters affect the intake manifold temperature which, in turn, affects the amount of heat that is transferred to the air from the manifold. The time constant associated with the manifold temperature keeps the actual air charge temperature from instantaneously achieving a steady state condition. A time constant in the actual air charge temperature calculation substantially tracks the time constant associated with the change in temperature of the manifold as it responds to changes in air flow conditions. This actual air charge temperture value can then be used to calculate an accurate air-fuel ratio.

4 Claims, 2 Drawing Sheets

FUEL INJECTION TEMPERATURE COMPENSATION SYSTEM

BACKGROUND OF THE INVENTION

This invention relates to a fuel supply temperature compensation system for an internal combustion engine and, more particularly, to a method for accurately predicting the density of the inlet charge to calculate the correct fuel quantity to be supplied to each cylinder.

In a speed-density fuel injection system it is essential to determine the density of the air entering each cylinder in order to calculate the correct fuel quantity. Since air density is a function of both pressure and temperature, this requires a determination of both the pressure and the temperature of the air entering the cylinder, commonly referred to as the charge pressure and the charge temperature.

It is well known in the automotive industry to measure the pressure using a manifold absolute pressure transducer and to measure the temperature using a sensor mounted in the inlet manifold. However, there is a problem with these temperature sensors in that they typically have a long time constant. For example, a typical temperature sensor may have a time constant of 15 seconds. This long delay results in fueling errors during transient engine conditions. In particular, the measured temperature reads higher than actual on acceleration and lower than actual on deceleration.

In automotive use, due to the lag in the temperature value displayed by these temperature sensors, inaccurate air-fuel ratios result. For example, when a vehicle is decelerating, air flow through the intake passage decreases thereby allowing the air temperature to increase as the air has more time to be heated by the manifold. However, this increased air temperature is not immediately indicated by the temperature sensor, so the resulting air-fuel ratio which is calculated using the inaccurate temperature value is itself inaccurate. Likewise, as the vehicle accelerates air flow through the intake passage increases which results in less time for the air to be heated by the manifold meaning the actual air temperature is lower than the value indicated by the temperature sensor, again causing inaccurate air-fuel ratio calculations.

SUMMARY OF THE INVENTION

This invention provides for a calculation of cylinder charge temperature rather than a measurement, thereby circumventing the fueling error problems of prior systems where air flow calculated by the engine control module (ECM) is inaccurate due to its inability to know the actual air density. The factors influencing air charge temperature are ambient temperature, coolant temperature and engine air flow. Ambient temperature and coolant temperature are presently measured by the ECM and the air flow through the intake passage of the manifold is calculated by the ECM.

In general, the subject invention measures ambient temperature and coolant temperature and then combines these values with an engine air flow estimate to generate a more accurate measurement of charge temperature than is obtainable from prior systems. Since neither ambient nor coolant temperature vary rapidly, the long time delay associated with temperature sensors is inconsequential and temperature sensors can still be used to accurately measure these values. The engine air flow estimate can be obtained in a variety of ways such as from a look up table containing a schedule of the air flow values as a function of manifold absolute pressure (MAP) and engine speed.

In the preferred embodiment of this invention, a charge temperature value can be estimated for any given air flow, coolant temperature and ambient temperature. A steady state charge temperature is calculated to determine the final charge temperature value the air will eventually achieve. This final air charge temperature value is then used to calculate an actual charge temperature, which represents the actual temperature of the air entering each cylinder over time.

The actual air charge temperature value does not instantaneously achieve a steady state value because it is dependent on the temperature of the intake manifold, which in turn is dependent on air flow, coolant temperature, and ambient temperature. Due to the thermal mass of the intake manifold, the temperature of the manifold will not change instantaneously as these parameters vary. The final air charge temperature is influenced by the time constant of the intake manifold temperature change. In the subject invention, the actual air charge temperature calculation contains a time constant that substantially tracks the time constant associated with the change in temperature of the intake manifold in response to changes in air flow conditions. As engine operating conditions approach and achieve a steady state operating condition, the actual charge temperature approaches and achieves the final charge temperature value. Because the calculated actual air charge temperature of the subject invention takes into account both steady state and transient conditions, the resulting air-fuel ratios are more accurate than those of prior systems.

One reason it is desirable to precisely control the air-fuel ratio is to maintain catalytic converter operation in both an oxidation and a reduction mode, making the clean up of hydrocarbons, carbon monoxide and nitrous oxide more efficient. Further, improving the air-fuel ratio accuracy also improves vehicle performance.

The foregoing and other objects of this invention may be best understood by reference to the following description of a preferred embodiment and the drawings in which.

DESCRIPTION OF THE PREFERRED EMBODIMENT

Figure 1:
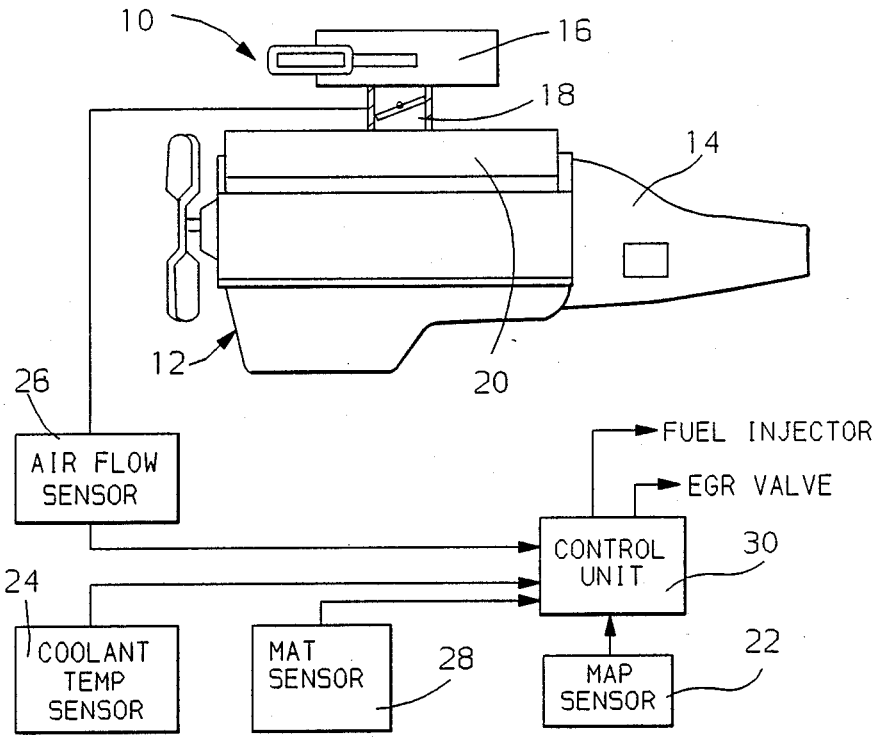
FIG. 1 is a schematic and block diagram of an embodiment of this invention with a vehicle engine.

Referring to FIG. 1, a motor vehicle drive train 10 is shown, mountable in a motor vehicle in the normal manner, although the vehicle itself is omitted from the Figure. The drive train 10 includes an internal combustion engine 12 with a transmission 14. The engine crankshaft drives the transmission 14 which in turn drives the wheels of the automobile.

Engine 10 is supplied with an air-fuel delivery system 16 of the type wherein the intake air flows from the atmosphere at ambient air temperature and past a throttle plate 18 which controls the regulation and flow of air into the intake manifold 20. Fuel can be delivered to a cylinder by any conventional means such as a fuel injection system, including fuel injectors for injecting fuel into the intake manifold 20.

Also associated with intake manifold 20 is a pressure sensor 22 for measuring manifold absolute pressure (MAP). MAP sensor 22 generates a signal indicative of the absolute pressure within the intake manifold downstream of the throttle plate 18. The MAP signal can then be used in base fuel calculations to determine the correct amount of fuel to be supplied to each cylinder.

In the preferred embodiment of this invention, the internal combustion engine is of the water cooled type where the coolant temperature of the engine is measured by a coolant temperature sensor 24. This value may be provided to an analog-to-digital converter to convert the temperature signal to a digital signal that may be utilized to predict the air charge temperature.

Since the air charge temperature is a function of coolant temperature, engine air flow and ambient temperature, it is necessary to determine all of these values to accurately predict the final air charge temperature. As mentioned, the coolant temperature is measured by coolant temperature sensor 24. In addition, air flow sensor 26 measures the engine air flow rate and the manifold air temperature sensor (MAT) 28 measures the ambient temperature. These parameters affect the intake manifold temperature, which in turn affects the amount of heat that is transferred to the air from the manifold. There is a time constant associated with the intake manifold temperature due to thermal mass and it is this time constant that keeps the actual charge temperature from instantaneously achieving a steady state condition. Consequently, the actual charge temperature is continuously filtered to create the trajectory of the temperature as it approaches a steady state value.

The system further includes a control unit 30 which is adapted to receive inputs from the various sensors described above. Control unit 30 then controls the various engine functions such as fuel injection and exhaust gas recirculation and also predicts the air charge temperature in accordance with the principles of this invention. It is understood that additional sensors or indicators and other control functions may be included in this system.

Figure 2:
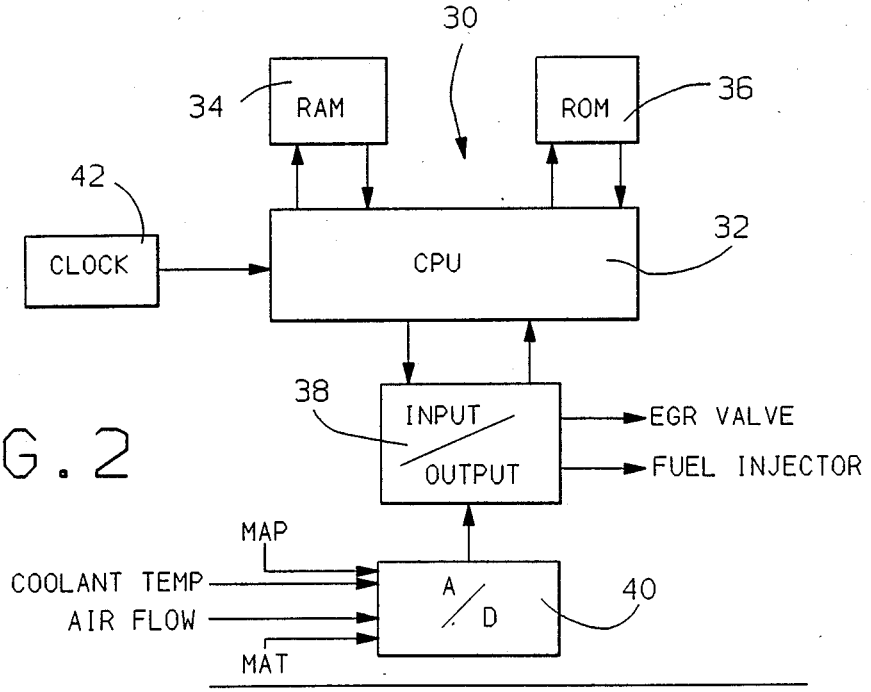
FIG. 2 illustrates a vehicle mounted computer which is a preferred embodiment of the control unit shown in FIG. 1.

The preferred embodiment of the control unit 30 is a vehicle mounted digital computer which accepts the various input signals and processes them according to a predetermined program. Referring to FIG. 2, the digital computer basically comprises a central processing unit (CPU) 32 which interfaces in the normal manner with a random access memory (RAM) 34, a read only memory (ROM) 36, an input/output unit (I/O) 38, an analog-to-digital converter (A/D) 40, and a clock 42.

In general, the CPU 32 executes an operating program permanently stored in the ROM 36 which also contains stored lookup tables addressed by selected parameters as will be described. The RAM 34 provides a convenient memory into which data may be temporarily stored and from which data may be read at various address locations determined in accordance with the operating program stored in the ROM 36.

In the operation of the digital computer of FIG. 2, certain input signals such as the manifold absolute pressure signal from the MAP sensor 22, the coolant temperature signal from the coolant temperature sensor 24, the air flow signal from the air flow sensor 26 and the manifold air temperature signal from the MAT sensor 28 are analog in nature and therefore are input to the A/D converter 40 to be converted to a digital signal before being provided to the I/O unit 38. The I/O unit 38 outputs control signals for controlling exhaust gas recirculation (EGR) and fuel injection.

Figure 3:
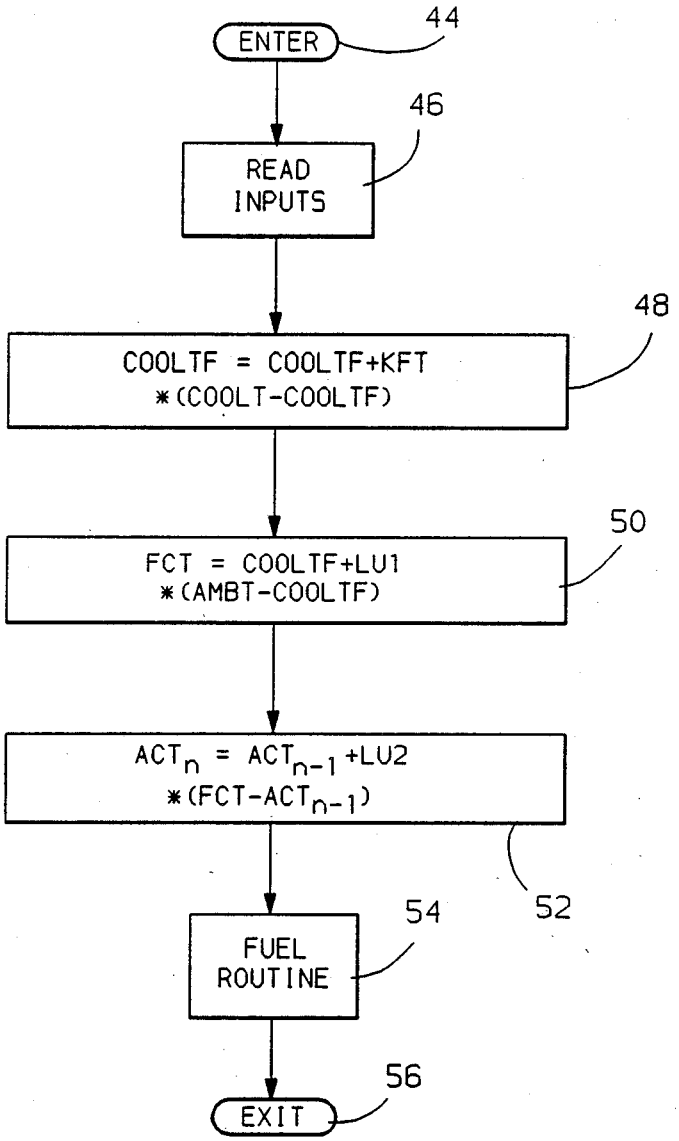
FIG. 3 is a flow chart for the control unit of FIG. 1 which is suitable for use in the computer shown in FIG. 2.

The digital control unit 30 depicted in FIG. 2 may be any of a variety of suitable units programmable by anyone of ordinary skill in the art according to the flow chart of FIG. 3.

Referring to FIG. 3, the temperature compensation program, which is entered at step 44, is continuously repeated at ordinary intervals. The program proceeds to step 46 where the control unit 30 is directed to read the various input signals described in reference to FIG. 1.

At step 48, the coolant temperature is filtered via a first order filter equation to reduce any signal noise which could cause the temperature to toggle unnecessarily between two temperature values. The coolant temperature is filtered via the equation:

$$COOLTF = COOLTF + KTF*(COOLT - COOLTF)$$

where COOLTF is the filtered coolant temperature, COOLT is the coolant temperature and KTF is a temperature filter time constant.

The filtered coolant temperature is then used in step 50 to calculate the steady state charge temperature using the equation:

$$FCT = COOLTF + LU1*(AMBT - COOLTF)$$

where FCT represents the final temperature that the air charge is expected to reach, AMBT is the ambient air temperature or the temperature of the air entering the intake manifold, and LU1 represents a value obtained from a first lookup table in the ROM which contains a schedule of final charge temperature values selected as a function of the engine air flow. When engine conditions change, the instantaneous temperature response is dictated primarily by the time constant of the intake manifold, where the time constant is a function of air flow. A new final air charge temperature is calculated each time the engine operating conditions change, based on changes in air flow, coolant temperature and ambient temperature. The resulting FCT value is indicative of the steady state temperature that the air will eventually achieve. This FCT value is then used in a first order lag filter equation in step 52 that calculates the actual instantaneous charge temperature by utilizing a filter time constant (LU2) that substantially matches the time constant of the intake manifold, so that the result is the actual temperature of the air entering the cylinder even during transient engine conditions:

$$ACT_n = ACT_{n-1} + LU2*(FCT - ACT_{n-1})$$

where $ACT_n$ is the new actual charge temperature, $ACT_{n-1}$ is the previously computed value of the actual charge temperature, FCT is the previously determined final steady state charge temperature and LU2 is a filter time constant. The time constant value LU2 is obtained from a second lookup table in the ROM 36 which contains a schedule of actual charge temperature values selected as a function of engine air flow. LU2 is a value that substantially matches the time constant of the intake manifold, where that time constant is a function of air flow and is determined experimentally and stored in the second lookup table. The actual air charge temperature value is then used in fuel calculations when the program proceeds to step 54 to execute the fuel routine.

The fuel routine uses the actual air charge temperature ($ACT_n$) term in calculating a new base pulse width, which is the energization time required to establish the requisite amount of fuel to be injected in each cylinder. The base pulse width, necessary to establish the correct air-fuel ratio, can be calculated using the equation:

$$BPW=(K/AF)*MAP*LU3$$

where BPW is the base pulse width, K is an injection constant, AF represents the air-fuel ratio required for each cylinder, MAP is the manifold absolute pressure, and LU3 is an inverse temperature correction factor dependent on air temperature and used to compensate for variations in density that result from variations in temperature. It is understood that other correction factors such as exhaust gas recirculation and volumetric efficiency may also be introduced into the base pulse width calculation. The base pulse width calculation uses the inverse temperature correction factor that is based on the air temperature from the actual charge temperature ($ACT_n$) equation to provide a more accurate determination of the base pulse width. The LU3 value is obtained from a third lookup table stored in the ROM 36 which contains inverse temperature correction factors as a function of the charge temperature, the temperature correction factors operating as density correction factors. After executing the fuel routine at step 54, the program exits at step 56.

The foregoing description of a preferred embodiment of the invention for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A fuel injection temperature compensation system for an internal combustion engine having combustion space into which air is drawn from the atmosphere through an intake manifold having a temperature varying in response to predetermined engine conditions in accord with a manifold temperature time constant that is dependent upon the value of the rate of air flow into the engine, the system comprising:

means for measuring the engine temperature;

means for measuring the atmospheric air temperature;

means for measuring the engine air flow rate;

means for predicting the steady state temperature of the air entering the combustion space as a predetermined function of the engine temperature, the atmospheric air temperature and the engine air flow rate;

means for determining the manifold temperature time constant corresponding to the measured engine air flow;

means for adjusting an actual temperature value toward the predicted steady state value in accord with the determined manifold temperature time constant; and means for establishing an air-fuel ratio by calculating a base pulse width from the actual air charge temperature.

2. A method of measuring combustion space air temperature in an internal combustion engine into which air is drawn into the combustion space from the atmosphere through an intake manifold having a temperature varying in response to predetermined engine conditions in accord with a manifold temperature time constant that is dependent upon the value of the rate of air flow into the engine, the method comprising the steps of:

storing a schedule of manifold temperature time constant values as a function of air flow rate values;

measuring the temperature of the engine;

measuring the temperature of the atmospheric air;

measuring the rate of air flow into the combustion space;

predicting a steady state temperature value of the air drawn into the combustion space in accord with a predetermined function of the measured engine temperature, atmospheric air temperature and air flow rate;

determining the manifold temperature time constant value corresponding to the measured rate of air flow into the engine; and adjusting the value of an indicated temperature of the air drawn into the combustion space toward the predetermined steady state temperature value in accord with the determined manifold temperature time constant value, whereby the indicated temperature is a measure of the actual temperature of the air drawn into the combustion space during transient and steady state engine operating conditions.

3. A method of measuring combustion space air temperature in an internal combustion engine into which air is drawn into the combustion space from the atmosphere through an intake manifold having a temperature varying in response to predetermined engine conditions in accord with a manifold temperature time constant that is dependent upon the value of the rate of air flow into the engine, the method comprising the steps of:

measuring the temperature COOLT of the engine;

measuring the temperature AMBT of the atmospheric air;

measuring the rate of air flow into the combustion space;

predicting a final steady state temperature value FCT of the air drawn into the combustion space in accord with the expression $$FCT=COOLT+LU1*(AMBT-COOLT)$$

where LU1 is a predetermined function of air flow rate;

storing a schedule of manifold temperature time constant values as a function of air flow rate values;

determining the manifold temperature time constant value LU2 corresponding to the measured rate of air flow into the engine; and determining the actual temperature of the air drawn into the combustion space in accord with the expression $$ACT_n=ACT_{n-1}+LU2*(FCT-ACT_{n-1})$$

where $ACT_n$ is the actual temperature of the air drawn into the combustion space and $ACT_{n-1}$ is the last determined value of the actual charge temperature.

4. For an internal combustion engine having combustion space into which air is drawn from the atmosphere through an intake manifold having a temperature varying in response to predetermined engine conditions in accord with a manifold temperature time constant that is dependent upon the value of the rate of air flow into the engine, the system comprising:

means for measuring the engine temperature;

means for measuring the atmospheric air temperature;

means for measuring the engine air flow rate;

memory means including (A) a first lookup table storing predetermined final air charge temperature time constants as a function of engine air flow, (B) a second lookup table storing predetermined actual air charge temperature time constants as a function of engine air flow, these values substantially representing the intake manifold transient temperature time constants and (C) a third lookup table storing predetermined inverse temperature correction factors as a function of the charge temperature, the inverse temperature correction factors comprising density correction factors used to calculate air-fuel ratios;

means for predicting the steady state temperature of the air entering the combustion space from the engine temperature, atmospheric air temperature, engine air flow and the final charge temperature time constant obtained from the first lookup table, this steady state air charge temperature comprising a final air charge temperature;

means for calculating an actual air charge temperature from the final air charge temperature and the actual charge temperature time constant obtained from the second lookup table; and means for calculating the base pulse width for establishing an air-fuel ratio from the actual air charge temperature value and the density correction factor obtained from the third lookup table.

* * * * *